United States Patent [19]

Potter

[11] Patent Number: 4,753,218

[45] Date of Patent: Jun. 28, 1988

[54] CONTINUOUS WATER WASH HOOD TYPE VENTILATING SYSTEM

[75] Inventor: Gary J. Potter, St. Charles County, Mo.

[73] Assignee: Cambridge Engineering, Inc., St. Louis, Mo.

[21] Appl. No.: 12,363

[22] Filed: Feb. 9, 1987

[51] Int. Cl.[4] ..... F24C 15/20

[52] U.S. Cl. ..... 126/299 E; 126/299 D; 55/228; 55/229; 55/DIG. 36; 55/240

[58] Field of Search ..... 126/299 R, 299 D, 299 E; 55/210, 212, DIG. 36, 273, 228, 242, 320; 261/117

[56] References Cited

U.S. PATENT DOCUMENTS

| | | | |
|---|---|---|---|
| 3,324,629 | 6/1967 | Graswich et al. | 126/299 E |
| 3,628,311 | 12/1971 | Costarella et al. | 126/299 E |
| 3,786,739 | 1/1974 | Wright | 126/299 E |
| 4,066,064 | 1/1978 | Vandas | 126/299 E |
| 4,351,652 | 9/1982 | Wisting | 126/299 E |
| 4,407,266 | 10/1983 | Molitor | 126/299 E |

*Primary Examiner*—James C. Yeung
*Attorney, Agent, or Firm*—Paul M. Denk

[57] ABSTRACT

A continuous water wash hood type ventilation system for installation over one or more cookers, wherein exhaust air is drawn into and passed through one or more hoods for scrubbing by a spray of recirculated solution, including a water-detergent combination, with each hood incorporating a canopy formed of a front, back, side and top walls, an exhaust outlet provided through the top wall, an exhaust chamber formed within the canopy by means of a series of arranged baffles, generally comprising an upper, intermediate, and lower baffle, all staggered, to adequately pass the exhaust gases through the canopy to achieve scrubbing and discharge, and for properly channelling the collection of the scrubbing solution within a basin for draining to a supply and recirculation reservoir. The recirculation unit of this invention includes its reservoir, a pump for recirculating the solution to the various spray heads embodied within the exhaust hoods, the reservoir holding the supply of water-detergent solution, and additional water may be added to the reservoir, to replenish any depleted stock, while further adding a quantity of detergent so as to maintain a specified concentration of the solution for use within the ventilating system; a drain may be provided for flushing all or part of the solution, and which accumulates grease and debris for collection of such impurities before the soiled water is discharged to the sewer system.

4 Claims, 3 Drawing Sheets

FIG. I.

CONTINUOUS WATER WASH HOOD TYPE VENTILATING SYSTEM

BACKGROUND OF THE INVENTION

This invention relates generally to the scrubbing of exhaust air within a ventilating hood and before it is discharged to the atmosphere, and more particularly pertains the recirculation of wash water containing a supply of detergent and which is useful for scrubbing of grease and other debris from the exhaust gases and air and for the accumulation and disposition of same through means that provide for a recirculation and reuse of the scrubbing water during operations of a ventilating system and subsequent disposition of contaminated solution from the system followed by regeneration of the solution.

Ventilating hoods have been around, and have been in existence, for many years, and are used primarily in conjunction with cooking devices, such as in restaurants, where codes require that the exhaust air and gases generated during a cooking procedures be significantly eliminated from the kitchen, or other facility. Examples of ventilating hoods can be seen in the U.S. Pat. No. 4,286,572, which U.S. patent is owned by a common assignee of the invention of this current application, in addition to the other prior art patents cited therein. In addition, there are a significant number of ventilating hoods that incorporate scrubbing means, principally for use in application for scrubbing the interior of the hood so as to eliminate accumulated greases, primarily for the purpose of preventing the incidence of fires and reduce manual cleaning requirements. Examples of these types of hoods can be seen in the U.S. Pat. No. 3,616,744 to Jensen, while the patent to Wisting, U.S. Pat. No. 4,351,652, shows the application of cascading water-detergent solution for removing any emulsified grease from the shown hood. The patent to Baker, U.S. Pat. No. 3,100,809, shows another form of exhaust hood with the exhaust air being washed by means of a spray. The patent to Graswich, et al, U.S. Pat. No. 3,324,629, shows upwardly directed spray means for use in providing a mist through which the exhaust gases must flow before exiting from the shown hood. The patent to Moragne, U.S. Pat. No. 3,494,108, shows another form of air cleaner, wherein the exhaust air is baffled for passage through a cleaning solvent before it is discharged to the atmosphere. The patent to Costarella, et al, U.S. Pat. No. 3,628,311, shows the application of a pair of sprays, directed into the exhaust plenums, in order to fill the same with moisture and through which the soot and grease particles must pass before exhausting. The patent to Wright, U.S. Pat. No. 3,802,329, discloses a grease extractor for kitchen ventilating systems. This device discloses a rather complex baffling system, through which the air is swirled apparently in an effort to eliminate any grease from the exhaust stream. The patent to Darm, U.S. Pat. No. 3,827,343, shows another form of grease-collecting heat exchanger installation. The patent to Wright, U.S. Pat. No. 3,786,739, shows another type of ventilating system, wherein a spray of moisture is directed throughout the exhaust chamber, in order to attain condensing of its ladened grease, and for extraction before the exhaust air passes through its outlet chamber. The patent to King, U.S. Pat. No. 4,071,019, shows another type of grease extractor arranged within a rather complex formed hood, wherein a cooled water spray is apparently injected within its exhaust chamber, to achieve grease removal.

The patent to Kaufman, et al, U.S. Pat. No. 4,085,735, shows another type of air ventilation and washing system. Spraying along the path of the air flow is noted. The patent to Scott, U.S. Pat. No. 4,231,765, shows a further type of air cleaning apparatus and method. The U.S. patent to Fritz, U.S. Pat. No. 4,323,373, shows an apparatus and method for cleaning air, wherein some spraying occurs at the upper segment of the unit, just prior to the entrance of the air through its exhaust duct. The patent to Stahl, U.S. Pat. No. 4,363,642, shows a control of range hood emissions, through the application of a fiber bed-type mist eliminating apparatus.

There are also a large variety of other types of air wash canopy ventilating systems, which are marketed by a variety of companies, such as the Ventroguard, as manufactured and sold by Quality Industries, of La-Vergne, Tenn. Similar type units are marketed by companies such as Caddy Corporation of America, Duo-Aire, Inc., of Kalamazoo, Mich., a fire and wash sprayer system for a kitchen hood, as sold by Ventroguard, Inc. A clean air ventilator, and which incorporates nozzle spraying, is marketed by Quest Metal Works, Ltd., of British Columbia, Canada. A device identified as Aquamatic, and which incorporates a multitude of water spraying, is manufactured and marketed by Aqumatic Systems, Ltd., of Reno, Nev. A device for ventilating kitchens is marketed under the name Aqua-Vent, by Atlantic Metal Fabricators, Inc., of Dorchester, Mass. Another unit for providing ventilation above gas or electric ranges is marketed under the name Simplex, by Doane Manufacturing Co., of Wheeling, Ill. Gaylord Ventilators, which incorporates hot water spraying, within or below a hood, is marketed by Gaylord Industries, Inc., of Wilsonville, Oreg. Greitzer, Inc., of Riverdale, N.J., markets a commercial kitchen ventilator system, and which incorporates spraying of hot water mainly for wash down of the interior of the hood, to function as an accumulated grease extractor. McGraw-Edison Company, of St. Louis, Mo., markets a Seco-Wash Ventilator, which incorporates the serpentine movement of exhaust gases through its hood, and embodies amorphous spraying of a hot-detergent water spray for eliminating and extracting grease.

Thus, in view of the foregoing, it can be seen that there are a large variety of ventilating hoods, which separately include either random spraying means for cleaning condensed grease off of the interior of the designed hood, or other units which circulate, or even recirculate, hot water, some even including detergent, for cleansing of the interior of a hood. Other devices add a mist or aerosol of moisture into a hood for air cleansing.

But, it does not appear that the prior art provides a comprehensive cold water and detergent solution wash within a ventilating hood, in proximity within an exhaust chamber, which directs a cone shaped and particularly configured spray that blankets and provides an aquatic shield throughout the exhaust chamber, and through which the exhaust gases must pass, for the purpose of scrubbing the air of its contained impurities, debris, and grease particles, for washing away an accumulation of such deleterious particles for collection within a reservoir and disposal. Then, the unit of this invention provides for recirculation of its reservoired cold water and detergent composition, and can sense when additional detergent, or clean water, must be added to the reservoir, in order to assure the efficient operations of this ventilating system of this invention.

It is, therefore, the principal object of this invention to provide a comprehensive cold water-detergent combination in solution recirculated within a particularly designed canopy, which may include a series of aligned or adjacent ventilating hoods, for scrubbing of deleterious particles from the exhaust air before it is discharged to the atmosphere, or perhaps even recirculated, under particular applications.

Another significant object of this invention is to provide a particularly configured and patterned spray of a water-detergent solution within the exhaust chamber of a ventilating hood for the purpose of providing an aquatic shield throughout the extent of the internal formed chamber for the purpose of scrubbing any debris, and grease, from the gases as they pass to and through the exhaust outlet for the system.

Still another object of this invention is to provide a structured ventilating hood, contained within a canopy, wherein a series of baffling means are particularly arranged in order to provide a flow path for the fumes and smoke arising from a cooker, fryer, or heating surface, and which channels said gases into an exhaust chamber where cold water wash scrubbing means effectively eliminates any debris from the traveling gases before they are exhausted to the atmosphere.

In view of the foregoing, it is another object of this invention to provide a minimum of baffle means particularly oriented within the ventilating system canopy, and which functions as a means for channeling the sprayed wash water towards a formed collection basin, where the accumulated water is drained to a reservoir, in preparation for recirculation within the wash water scrubbing system of this invention.

Another object of this invention is to provide means within a recirculation unit, used in conjunction with a ventilating system, sensing and detecting when additional detergent is required, fresh wash water is needed, for all adding such compositions into a recirculation reservoir before it is pumped to the spray heads contained within the exhaust hood of the configured ventilating system.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the structure of a ventilating hood, or a series of hoods, fabricated in overall design as canopies, and which are incorporated into a ventilating system which includes wash water scrubbing of the exhaust air arising from cookers, or the like, as installed in restaurants, or heaters within chemical installations, or the like. The significance of this invention is incorporating into the operations of such a ventilating system the concept of preferably the utilization of cold water scrubbing, althrough warm or hot water may likely be used, in combination with a quantity of detergent, and all which is recirculated in combination within the ventilating system to assure adequate scrubbing of the exhaust gases of their laddened grease particles, debris, or other deleterious elements with a minimal impact on water supply usage or waste water load. The invention, through its operations, scrubs such particles from the exhausting air, accumulates the same within a collection basin, since each canopy includes a series of particularly arranged baffles, which are designed for achieving a directing and accumulation of the sprayed solution, within a basin, for draining to a reservoir, where solution detection and monitoring can continuously take place, for determining when the solution must be replaced, simply have water added to it, include the addition of further detergent, and when sufficient grease and debris has settled within the reservoir and needs to be disposed of. Thus, the concept of this invention through the recirculation of its water-detergent composition provides desirably for reduced utility costs, in the form of conservation of water, and since the invention envisions the application of a cold water scrubbing of the exhaust gases, also eliminates the need for heating elements, as required in most of the prior art devices.

The ventilating system of this invention incorporates, as previously explained, one or more ventilting hoods, each hood formed as a canopy, having front, back, side and top walls, with an exhaust outlet provided through one of said walls, preferably in its arranged top wall. Within the canopy are a series of baffle means, designed, as previously explained, for channelling the exhaust gases into the system hood, with said baffling means likewise providing a staggered relationship for additional "washing" of the exhaust air so as to precool as well as coagulate grease particles and directly remove particulates from the exhaust air through an aquatic film passing through the air passage corridor of this system. This occurs because the wash water cascades off the baffling means to provide water solution curtains through which the exhaust gases initially pass. This is shown at D in FIG. 2. In addition, the arranged baffles provide the formation of an exhaust chamber, within the hood structure, and disposed in the course of the air flow just in front of its exhaust outlet, and wherein the spray means of this invention is arranged. The spray means includes one or more spray heads, and which are designed for projecting a rather cone shaped spray of the solution throughout the exhaust chamber, in the form of a centrifugal or swirling spray, forming an aquatic-like shield across the chamber and through which all of the exhaust gases must pass as they are attracted towards its outlet, where an exhaust, or other blower means, provides the means for attraction of the fumes and smoke towards the exhaust hood, for its removal. The swirling spray shield has a tendency to cast the gas entrained debris and grease to the side, filter it out of the gas, for their combined flow to the collection reservoir. The recirculation reservoir of this invention is embodied within a recirculation unit, and which incorporates controls, including electrical or electronic controls, in addition to valves, and other pressure sensing means, for providing adequate recirculation of the scrubbing solution, which includes the combination of water and detergent, at their proper proportions, to assure the efficient operations of this system. The recirculation unit includes a detergent supply, means for detecting when additional detergent must be injected into the reservoir, for enhancing its strength within the scrubbing solution. In addition, it may be that additional water must be added to the solution, in order to replenish the recirculation reservoir supply, particularly if some amount of the solution and water have been exhausted from the system, evaporated, or generally otherwise dissipated, such as when grease or other debris may be trapped wtihin the reservoir.

Thus, the invention includes means for detecting the water level, and determines when additional cold water supply must be added to the reservoir to replenish its quantity. Furthermore, the recirculation unit does include a reservoir with sufficient quantity of water so as to accumulate grease and other debris, all of which become entrained within the cleansing solution, as it is returned to the reservoir, for effectively eliminating those types of deleterious elements from the scrubbing solution. By holding the deleterious elements in suspension, the recirculation pump can intake solution that has yet to encompass the contaminated elements.

The cleansing and scrubbing solution of this invention is monitored for determining the exact amount of water, detergent, and their concentration, for determining when an automatic detergent feeder must add additional of this component into the solution. Generally, the concept of this invention is to utilize a cold water solution, for purposes as previously explained, but if necessary, warm or other water could also be utilized. The detergent used in this invention, and which has been found preferable, is the CE109 detergent available from Cambridge Engineering of St. Louis, Mo., and is generally fabricated from chemicals in the category of a cleansing alkaline solution containing potassium hydroxide. The more specific ingredients include a nine percent water solution of potassium hydroxide, with a minor percentage of polyphosphate. The detergent may also include an odor neutralizer, in order to reduce the odors of the exhausting gases, and in addition, may include a small quantity of a bactericide, in order to eradicate any organisms. Generally, the solution is made of approximately 99%, more or less, of water, and the potassium hydroxide, with the detergent, in the amount of 1%, plus or minus, in the combination. The solution is sprayed into the hood, through the spray heads, in a quantity of approximately 2 to 5 gallons per minute. It has been found that this amount of spraying may vary as much as 1 to 3 gallons per foot of hood length, depending upon the number of spray heads located within the canopy, their spacing apart, and the quantity of air being attracted therethrough by the exhaust system and still achieve the high degree of grease extraction. Normally, exhaust air is attracted into a ventilating hood in a range of approximately 200 to 450 cubic feet per minute per foot of hood. Thus, the quantity of solution sprayed, for the normal operations of a standard ventilating hood, can be reasonably determined from this empirical data.

In addition, the type of spray heads utilized in this invention are generally fabricated to provide a cone shaped spray, at a wide angle of discharge, to provide a thin layer or blanket of solution, to form that aquatic shield, as previously mentioned, that extends throughout the entire exhaust chamber fabricated into the hood of this invention. One or more of properly located and reasonably spaced spray heads, depending upon their spraying capacity, and the pressure of the solution being discharged, may be required, but the object of the invention is to provide that aquatic shield, of a sprayed water-detergent solution, that completely encompasses the cross section of the formed canopy to assure that adequate scrubbing of all of the exhaust attracted into the hood, and passing through the exhaust chamber, are adquately and efficiently scrubbed. Generally, the system has been determined to provide for an approximate ninety-nine and above per cent removal of grease and major particulate matter through complete scrubbing of the exhaust air stream passing through the hood of this invention. The spray heads, as previously explained, are available from Spraying System Co, of Wheaton, Ill., under manufacturer's part number 3/8E53.

The object of this invention is to provide a continuous cold water wash hood, as previously reviewed. It affords clean, problem-free air exhaust generally to the roof or near the wall of the structure in which the hood is mounted, and even if the hood is located near windows, sky lights, or the like, the exhaust air being cleansed of any deleterious particles will avoid tarnishing of these building components. Furthermore, usage of this particular invention avoids building sewage operating problems, eliminates their maintenance, and other clean-out costs. The hood furthermore meets stringent air quality standards. In function, the hood provides for a continuous emulsification of the captured grease into a homogeneous, room-temperature solution for trouble-free disposal. Only small amounts of added detergent are required for replenishing the water supply, in an unheated supply of water used in this wash water hood, through the operations of a fully-automatic system that thereby conserves water, and eliminates the need to dispose of large quantities of waste solution to the sewage system. Continuous electronic monitoring of the solution, during recirculation, and within its reservoir, assures superb performance and maximum efficiency. It should be noted that this feature is not absolutely necessary and the system operation could be controlled by timers or other controllers to achieve proper detergent solution control and dumping or disposal of the contaminated solution. Thus, through the operations of this device(s), and where this hood is installed within a restaurant or related type of facility, through its operations, it projects a clean, healthful image to the customer, and neighbors, by keeping the building and its surroundings completely free of any grease or other contaminating appearances. Furthermore, it protects the roof of the building or restaurant from grease build-up, which under normal circumstances, could present a dangerous fire hazard, and which is a leading cause of premature roof failure and repair cost. In addition, through usage of this particular invention, maintenance and repair costs are significantly reduced. The invention eliminates the need for periodic exhaust duct and exhaust fan cleaning, and daily grease filter removal and cleaning and other grease control maintenance programs are significantly reduced, if not eliminated. Furthermore, since the grease is held in suspension via the chemical properites of the recirculated solution in the reservoir and not subjected to grease elements collecting or building onto each other, this invention protects against grease build-up in the sewer system, thereby eliminating sewer back-up and other disposal problems. Furthermore, since the grease is treated in this manner, it saves the cost of a need for any larger type of grease interceptor, which may be required under circumstances where accumulations of grease are flushed into the sewage system, such as in the fast food, fried foods type of restaurants. This device, in its operations, requires only unheated water.

This invention furnishes a continuous grease-free exhaust air as discharged to the atmosphere, or recirculated. This high level of grease extraction results from a triple action process. Initially, the specifically designed air flow path penetrates the first aquatic film which serves to cleanse the air and cool the air and then it centrifugally spins out air borne grease particles against detergent and water coated inner surfaces of the fabricated hood. Secondly, the air is slowed and cooled, causing vaporized greases to condense and cluster for subsequent removal. The cycle is repeated as the exhaust air penetrates that second water fall arrangement and then the air is thoroughly scrubbed by the application of spray heads, that provide that acquatic-like shield within the formed canopy, and which provides air wash sprays to remove the remaining entrained grease particles. Then, the moist air is drawn through the self-draining, self-cleaning moisture eliminators, in order to provide what has been effectively determined as a 99% removal of grease particles from the exhaust air stream.

The system of this invention, as previously explained, may include one or more of hoods, either arranged in adjacency, or back to back, and which may all operate from a singular recirculation reservoir, and unit, to achieve the adequate scrubbing of the capacity of exhausting air being attracted into and through the combination of hoods of the system.

BRIEF DESCRIPTION OF THE DRAWINGS

In referring to the drawings, FIG. 1 provides an isometric view of one of the ventilating hoods of this invention, being partially broken away, in order to disclose its interior canopy components, such as baffling means, as the exhaust gases pass through the arranged solution sprays of the invention.

DESCRIPTION OF THE PREFERRED EMBODIMENT

Figure 1:
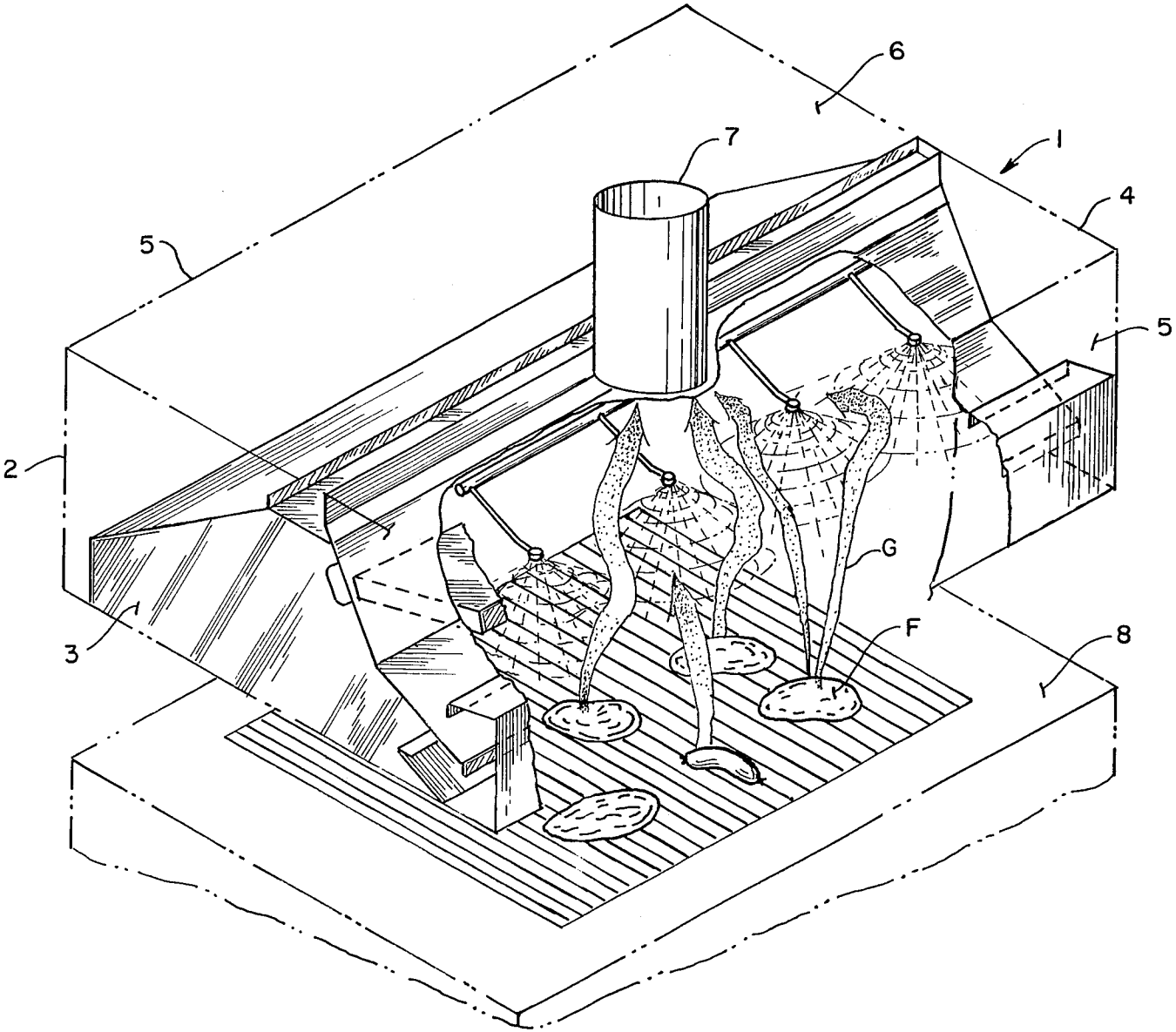
Figure 2:
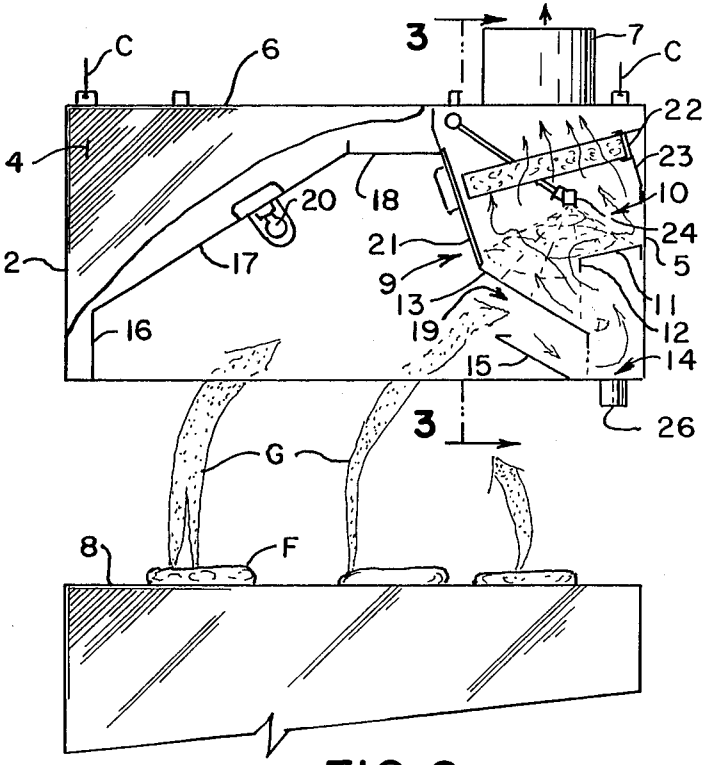
FIG. 2 is a side view of the invention, as shown in FIG. 1, with one end wall being partially broken away in order to disclose the internal operating components of the system.

In referring to the drawings, and in particular FIGS. 1 through 4, the ventilating hood 1 of this invention is disclosed. The hood includes a canopy means, as shown, and which incorporates a series of front wall 2, side walls 3 and 4, back wall 5, and a top wall 6. Through the top wall is provided an exhaust outlet duct 7 and which may incorporate therein, or leads towards, an exhaust fan (not shown) which may be strategically operated in order to function to draw down the pressure of the air under the hood, in order to attract the capacity of air therein as previously summarized. In any event, the entire hood arrangement 1 will normally be located over some type of heating surface, as at 8, which, as for example, may be used for frying foods, such as that disclosed at F, and the exhaust gases of which, as noted at G, will be attracted upwardly into the ventilating hood, for exhausting to the atmosphere.

The hood of this invention may be secured or otherwise bolted to the wall of any adjacent structure, as normally done, or it may be suspended, by means of support rods C, from the ceiling or roof of the structure in which it is installed.

The specific structure of the canopy 2 of this invention, internally, includes a series of arranged baffle means, generally disclosed a 9, and which are structured to provide for means for channeling the exhaust gases into a formed exhaust chamber 10 while at the same time properly directing and accumulating any of the sprayed solution as previously defined into a position where it will be collected, and drained, to a reservoir, as to be subsequently analyzed. More specifically, an upper baffle means 11 is mounted extending from the back wall 5, and is arranged in a downwardly and forwardly extending position. It includes various marginal lips, as can be seen at 12, in order to structurally reinforce the baffle during the life of its installation and usage. Another or intermediate baffle means 13 is provided extending rearwardly and downwardly, within the back portion of the canopy, and is designed generally arranged beneath the previously defined baffle means 11. Thus, as can readily be seen, when any solution is sprayed within the exhaust chamber 10, it will be accumulated and directed generally downwardly, and centrally, of the arranged baffle means, for collection, and also provide a water fall barrier for the air to pass through. The collection occurs within a basin, formed as at 14, and this is constructed by means of the arrangement of a lower baffle means 15, that extends the entire length, or the width, of the canopy 2, to provide a basin that is readily disposed for collection of solution, as sprayed throughout the length of the hood, as can be seen. All of the various baffle means, as noted at 12, 13, and 15, contain various marginal bends, as previously noted, in order to reinforce them throughout their extent.

It can be seen that the canopy 2 includes various internal surfaces, generally formed of sheet metal material, as noted at 16 through 18, providing arranged surfaces for the structured hood, and generally providing for a shaped plenum in which the exhaust gases, as they arise, are oriented in a rearward direction towards the entrance, as 19, into the inlet of the exhaust chamber 10, formed by the variety of specifically arranged baffle means, as previously explained. A light may be provided at 20, for illumination pruposes, and an access panel, as at 21, is provided within the structure of the canopy, as noted, in order to attain access into the formed exhaust chamber 10, and likewise, to provide means for removal of the moisture eliminators 22, which are provided generally along the length of the formed hood. These filters 22 are supported in their arrangement by means of the bracket 23, as can be seen.

Figure 3:
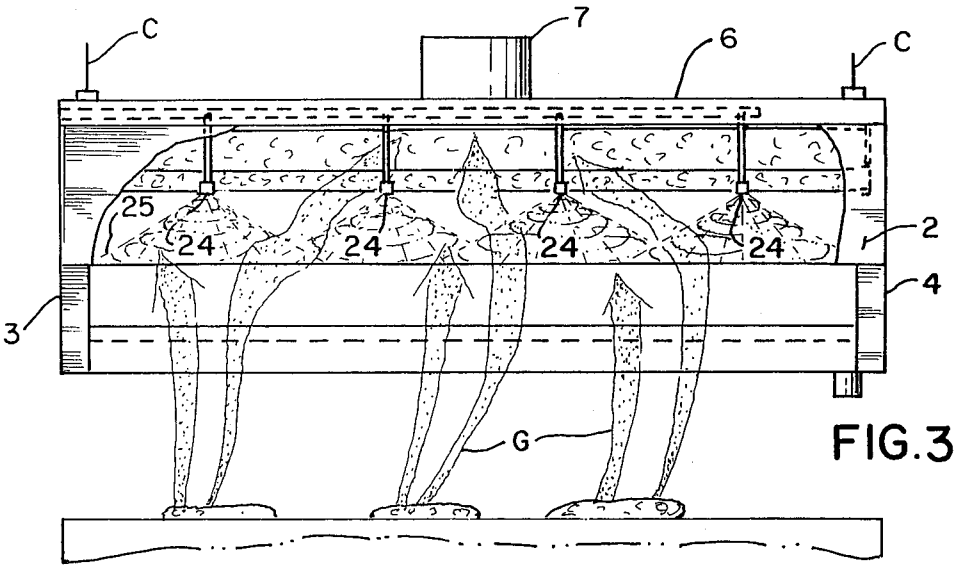
FIG. 3 is a front view of the invention, with its front wall being partially broken away in order to disclose its internal operating components.
Figure 4:
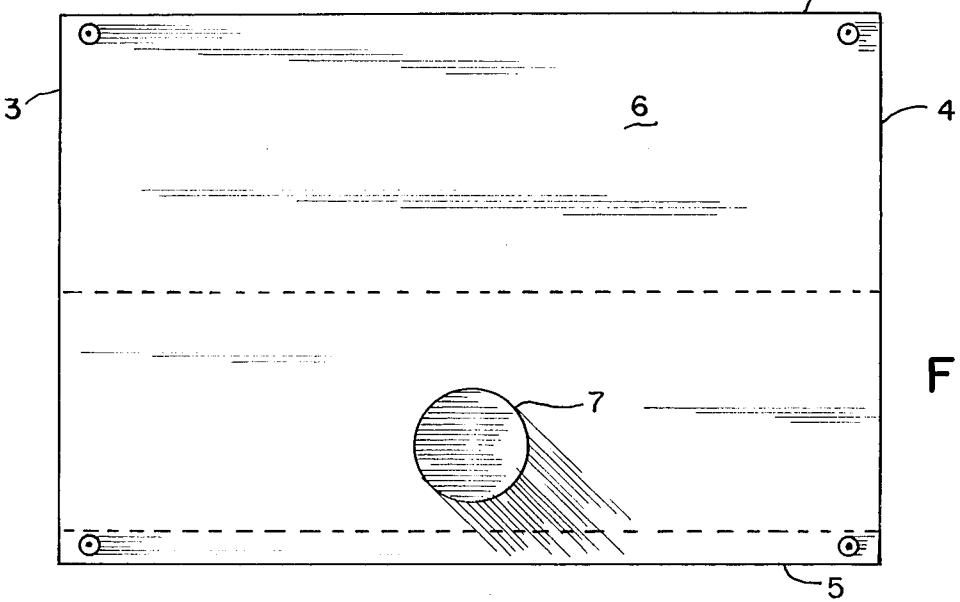
FIG. 4 is a top view of the ventilating hood.

These moisture eliminators 22 are generally fabricated of expanded metal, or contain metalic filter elements, are approved generally by Underwriter's Laboratory for usage within a ventilating hood, of this type, and normally can be removed, and cleaned, periodically, as required. Some grease and substantial moisture do accumulate and condense upon the filter, as can be understood. But, arranged within the exhaust chamber 10 of this invention is one of the spray heads, as at 24, and which is designed to function in the manner to provide a spray within the lower segment of the said exhaust chamber, in the manner as previously analyzed. As can be seen in FIG. 3, there may be a series of such spray heads 24 within each structured hood. As can also be seen within the designated figure, the spray heads are generally designed for generating a rather cone shaped sheet of spray, such as designated at 25, and the purpose of this is to provide and furnish that aquatic type of shield, throughout the entire length and width of the formed hood, in order to provide a continuous spread of a veil of water-detergent combination throughout the entire canopy, to assure that all exhaust gases being attracted into and through the hood, and into the exhaust chamber, are exposed to the cleansing effect of the sprayed solution that forms the aquatic shield to assure that grease particles, particulate matter, and other debris, are adequately scrubbed from the passing fumes and gases. Those particles of grease in gas that may yet escape past the aquatic shield are then captured by centrifugal or other related action to the eliminator 22, but as can readily understood, such a device does not accumulate near as much of such debris as would normally occur under those circumstances when a spray of solution would not be provided within the formed canopy, of the type such as shown in this invention since a significant amount of water carryover is also drawn into the filters for entrapment. This moisture tends to cleanse the filters and wash away the captured grease. Since the function of the filter is more to eliminate moisture droplets from the exhaust air, the term moisture extractor is generally perceived to be more descriptive. Most of the condensed grease and particulate matter, entrained within the moving exhaust gases, are scrubbed by the action of the sprayer, in forming the solution shield therein, in the manner as previously defined, with the entrained debris within the solution falling downwardly, upon the various baffle means 11 and 13, for eventually draining downwardly into the collection basin 14, and for being drained away. As can be seen a drain pipe 26 is provided at the bottom of the basin 14, to furnish means for conveyance of the sprayed solution away to its supply reservoir.

Figure 5:
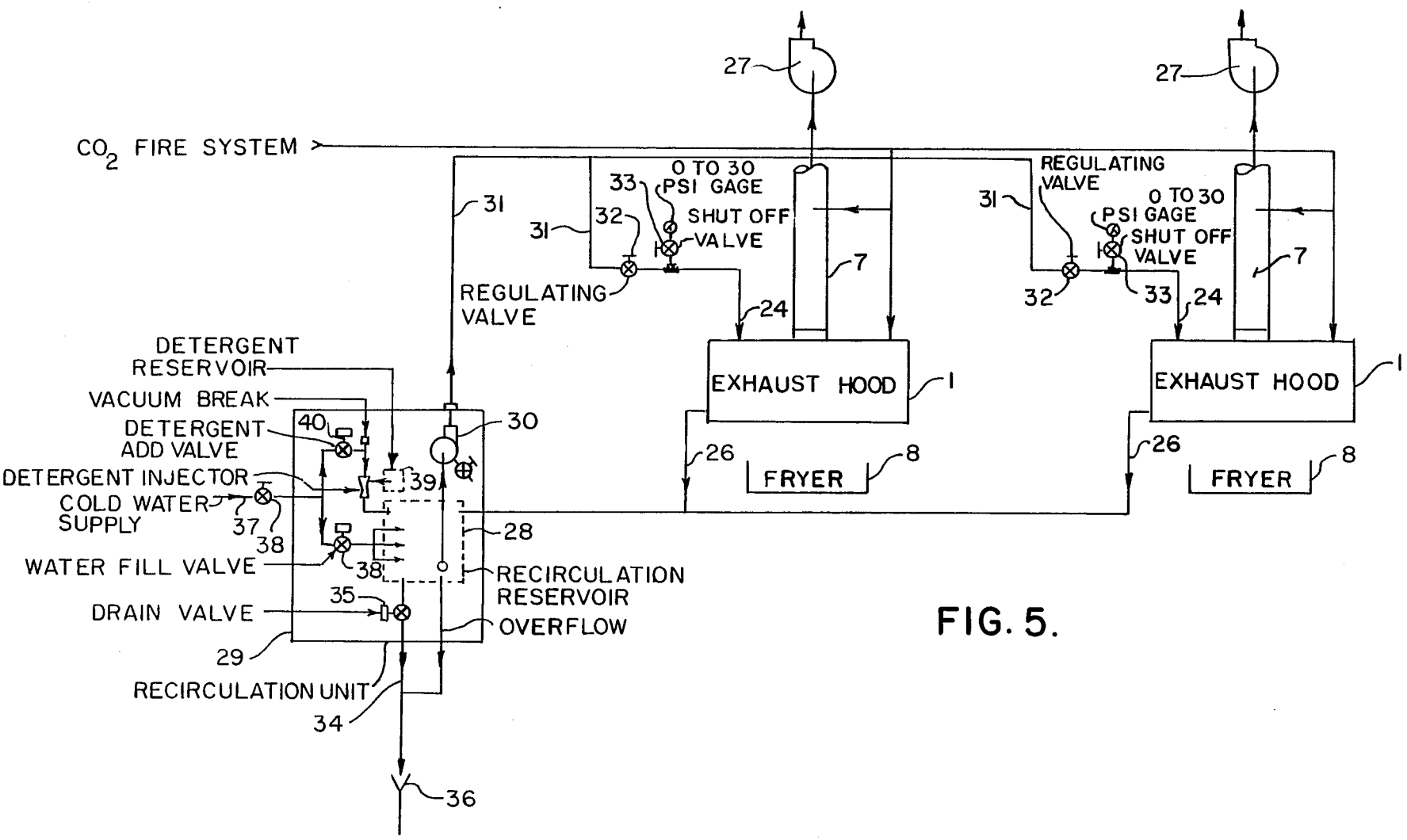
FIG. 5 is a schematic disclosing of the arrangement of a pair of the exhaust hoods, and the flow chart showing the relationship and internal components of the recirculation unit, for supplying the cleansing and scrubbing solution to the hoods during the operations of the ventilating system of this invention.

As can be seen in FIG. 5 of the drawings, the schematic of the flow diagram for movement of the prepared solution throughout the system of this invention is readily disclosed. As can be noted, in this particular example, a pair of exhaust hoods 1 are provided. Each exhaust hood includes its own exhaust outlet 7, and which attract therein the exhaust gases for discharge to atmosphere, through the operations of the exhaust blowers 27. And, as can be further noted, each exhaust hood is operatively associated wtih a heater or fryer unit 8, or groups of like equipment as previously explained.

The spray solution of this invention is utilized in the manner as previously explained, and when it is drained from the various collection basins 14, and discharged through the pipes 26, it is transferred, by gravity, or otherwise, to a recirculation reservoir 28. The recirculation reservoir is contained within a recirculation unit 29 which functions to provide for the adequate supply and circulation of the cleansing solution of this invention, during the routine operations of its air scrubbing system. The solution contained within the recirculation reservoir 28 is pumped, by means of the pump 30, out of the bottom of the reservoir, through the flow line 31 and to the spray heads 24, for each of the hoods as shown. Various types of regulating valves 25, and pressure sensitive shut-off valves 26 may be provided for controlling the flow of solution through the flow line 31, as may be required.

The recirculation reservoir 28 of this invention is designed for holding a supply of the scrubbing solution of this invention, as previously explained. In addition, the reservoir includes a drain, as at 34, operated by means of the valve 35, which allows the discharge of soiled solution to the sewer line 36. Furthermore, when the level of solution in the reservoir is reduced, either by drain off, evaporation, or the like, in may be necessary to add additional water to the reeservoir. This is achieved through a cold water supply line 37 and upon operations of its various valves 38, water can be added to the said reservoir. In addition, a detergent reservoir 39 contains a supply of the identified detergent, and upon operations of its valve 40, a supply of detergent, in conjunction with the flow of water, can be added to the said reservoir.

Although it is not shown, the reservoir may contain other detection means for determining just when water, or detergent, is required to be added to the system or may have timers set for adding detergent in combination with known flow rates of solution. The reservoir may include means for monitoring the amount of water in the reservoir, the concentration of the detergent therein, and signaling may be provided, as through either an audible or illuminated signal to let the operator know when these supplies become low. In addition, electronic means may be utilized for the timed addition and injection of additional detergent into the reservoir, in addition to water, and by gauging the concentration of the solution, can determine when a constant solution strength, of approximately one per cent detergent, is automatically maintained by the concentration controller. Any conductivity sensor probe located within the recirculation reservoir can continuously monitor the solution strength, and determine when is concentration drops, and therefore, needs replenishing. Any type of automatic means may be used for operation of the various water and detergent valves, in time relationship, for adding a specific concentration of detergent to water in order to achieve a proper solution within the recirculation reservoir. Specific information relative to these various operating components are readily disclosed in the applicant's published operation and maintenance manual, a copy of which is appended to this application and incorporated herein by reference.

The system of this invention includes this recirculation unit 29, which is used to monitor, control, recirculate and periodically flush and renew the scrubbing solution. This recirculation is essential to the system and to maintain its ability to provide continuously high extraction performance of deleterious particles from the exhausting gases, with low water consumption, low detergent usage, reduced energy requirements, and to generate small quantities of waste effluent, which can be flushed, and trapped, as required. The recirculation unit, as previously explained, can be provided for continuous electronic monitoring and control of the solution concentration, automatically add detergent, and periodically flush spent solution and replace it with fresh water-detergent combination as required. All this may be fully automatic.

Variations or modifications to the subject matter of this invention may occur to those skilled in the art upon reviewing the disclosure herein. The description of the preferred embodiment as provided in this application, and the structural arrangement of the drawings as disclosed, are set forth for illustrative purposes only. Any variations or modifications to the structure and operations of this invention, but yet which are within the spirit of this invention, are intended to be encompased within the scope of any claims to patent protection issuing upon this development.

Having thus described the invention what is claimed and desired to be secured by Letters Patent is:

1. A continuous water wash hood type ventilating system for installation over one or more cookers, heaters, or the like, wherein the exhaust air drawn into and passing through one or more hoods is scrubbed by a spray of recirculated water, wherein each hood incorporating a canopy formed having a front, back, side, and top walls, an exhaust outlet incorporated through one of said walls, an exhaust chamber provided within the canopy and communicating with the outlet, a series of baffle means structured into the interior of the canopy at the entrance to the exhaust chamber and providing a circuitous path for movement of the exhaust air arising from the cooker, while also providing a channeling means for flow and collection of the sprayed water, and said baffle means including a series of vertically staggered and overlapping baffles, an upper baffle connecting with the back wall and extending forwardly and downwardly within the canopy, an intermediate baffle connecting with the canopy and extending rearwardly and downwardly beneath the arranged upper baffle, and a lower baffle connecting within the canopy and extending forwardly and upwardly beneath the intermediate baffle, said lower baffle shaped to form the said collection basin for accumulation of the sprayed air scrubbing water, and wherein said baffling means being disposed for effecting a cascading of the scrubbing water to provide a precooling of the exhaust gases before their passage through the sprayed water, a series of spray heads arranged the length of the canopy and within the exhaust chamber to form an aquatic shield therein during hood operations, said spray heads arranged within the canopy and above the baffle means and each provided for discharging a cone shaped spray of water for furnishing an aquatic shield throughout the exhaust chamber and through which the exhaust air must pass for scrubbing before exiting the canopy via the exhaust outlet, a collection basin operatively associated with the canopy and arranged downwardly of the baffle means for accumulation of the sprayed air scrubbing water, a drain connecting with the basin, a reservoir communicating with the drain for deposit and collection of the water, and a recirculation pump communicating with said reservoir for returning the wash water to the spray heads during functioning of the ventilating system.

2. The invention of claim 1 and wherein said wash water containing a detergent.

3. The invention of claim 2 and wherein said reservoir being operatively associated with a recirculation unit means, said recirculation unit means incorporating means for accumulating grease and debris from the wash water and disposing of same, said recirculation unit means incorporating means for replenishing and adding clean additional water to the reservoir, said recirculation unit means incorporating means for adding additional detergent to the reservoir, and said recirculation unit means incorporating means for timing of its operations.

4. The invention of claim 1 and including at least one moisture eliminator arranged between the spray head and the exhaust outlet to aid in the collection of deleterious particles and condensation of moisture before passing the cleansed exhaust air through the said outlet.

* * * * *